US007461609B1

(12) United States Patent
Ott et al.

(10) Patent No.: US 7,461,609 B1
(45) Date of Patent: Dec. 9, 2008

(54) APPARATUS FOR CONTROL OF PIVOTING WING-TYPE SAIL

(75) Inventors: Mark T. Ott, Kailua, HI (US); David W. Hubbard, Stamford, CT (US)

(73) Assignee: Harbor Wing Technologies, Inc., Seattle, WA (US)

( * ) Notice: Subject to any disclaimer, the term of this patent is extended or adjusted under 35 U.S.C. 154(b) by 0 days.

(21) Appl. No.: 11/706,796

(22) Filed: Feb. 14, 2007

(51) Int. Cl.
*B63H 9/04* (2006.01)

(52) U.S. Cl. ..... 114/102.29; 114/102.1; 114/102.13

(58) Field of Classification Search ..... 114/102.12–102.22, 102.24–102.33, 108
See application file for complete search history.

(56) References Cited

U.S. PATENT DOCUMENTS

| | | | | |
|---|---|---|---|---|
| 3,381,647 | A | 5/1968 | Keeler | |
| 3,580,203 | A | 5/1971 | Martin | |
| 3,800,724 | A * | 4/1974 | Tracy | 114/39.24 |
| 3,802,366 | A | 4/1974 | Mankawich | |
| 3,844,238 | A | 10/1974 | Murray | |
| 4,386,574 | A | 6/1983 | Riolland | |
| 4,388,888 | A | 6/1983 | Gushurst, Jr. | |
| 4,402,277 | A | 9/1983 | Wainwright | |
| 4,432,298 | A | 2/1984 | Cudmore | |
| 4,467,741 | A | 8/1984 | Walker | |
| 4,473,023 | A | 9/1984 | Walker | |
| 4,506,619 | A | 3/1985 | Bates et al. | |
| 4,530,301 | A | 7/1985 | Latham | |
| 4,537,146 | A | 8/1985 | Wainwright | |
| 4,543,899 | A | 10/1985 | Walker | |
| 4,561,374 | A | 12/1985 | Asker | |
| 4,563,970 | A | 1/1986 | Walker | |
| 4,582,013 | A | 4/1986 | Holland, Jr. | |
| 4,669,409 | A | 6/1987 | Asker | |
| 4,685,410 | A | 8/1987 | Fuller | |
| 4,733,624 | A | 3/1988 | Belvedere | |
| 4,770,113 | A | 9/1988 | Walker | |
| 4,843,987 | A | 7/1989 | Samuels | |

(Continued)

FOREIGN PATENT DOCUMENTS

| | | | |
|---|---|---|---|
| FR | 2382370 A | * | 11/1978 |
| GB | 2369337 A | * | 5/2002 |

*Primary Examiner*—Jesús D. Sotelo
*Assistant Examiner*—Daniel V Venne
(74) *Attorney, Agent, or Firm*—Todd N. Hathaway

(57) ABSTRACT

A steerable wing-type sail system for a wind powered craft. The system includes first and second secondary airfoils and that are spaced outwardly to the sides of the plane of the main wing, and that are positioned rearwardly of the trailing edge of the wing. The secondary airfoils are selectively pivotable so as to steer the main wing in one direction or the other. The main wing is also provided with a pivoting flap at its trailing edge, which pivots simultaneously with and in the same direction as the secondary airfoils. The secondary airfoils are carried on elongate horizontal booms mounted near the mid-span height of the main wing. The secondary airfoils pivot about vertical axes at the distal ends of the booms, and are operated by control cables that are retracted and paid out by linear actuators or similar mechanisms. The craft may be multi-hull vessel, such as a catamaran. The control mechanism for the secondary airfoils may operate the airfoils in response to signals received from one or more onboard sensors. The system is suitable for use on an autonomous unmanned surface vessel (AUSV).

23 Claims, 7 Drawing Sheets

U.S. PATENT DOCUMENTS 4,856,449 A 8/1989 Walker
4,945,847 A 8/1990 Walker
4,982,679 A 1/1991 Walker
5,211,123 A 5/1993 Greenwood
5,263,429 A 11/1993 Brinkmann
5,575,233 A * 11/1996 Walker ..... 114/102.22
5,622,131 A * 4/1997 Walker ..... 114/102.29
5,868,092 A 2/1999 Milidragovic
6,341,571 B1 * 1/2002 Russell et al. ..... 114/39.21
7,252,264 B2 * 8/2007 Nattinger ..... 244/2

* cited by examiner

APPARATUS FOR CONTROL OF PIVOTING WING-TYPE SAIL

BACKGROUND a. Field of the Invention

The present invention relates generally to wing-type sails used by wind-powered vessels, and more particularly, to an apparatus for controllably steering a wing-type sail using at least one pair of auxiliary airfoils that are displaced laterally from the main wing.

b. Related Art

Wing-type sails are known for use on wind-powered vessels of various types. By comparison with traditional flexible sails, wing-type sails (referred to from time to time here and after simply as "wings") are typically rigid or semi-rigid airfoils that develop "lift" from the passage of wind thereover in a manner similar to an aircraft wing, although in the case of a watercraft or similar vessel the wing is mounted vertically and normally has a symmetrical cross section.

Generating useful propulsive force in any given direction therefore requires the ability to controllably align the wing relative to the direction of the wind. Conventionally, this has been accomplished using a pivotable flap or air foil located at or near the trailing edge of the main wing and in the same plane on the wing. The main wing is pivotable about the vertical axis, and the trailing edge flap reacts to the air flow to control the direction and amount of lift that is produced by the wing. The wing assembly is free to rotate through a complete circle, thus allowing the vessel to be propelled in virtually in direction.

Although this system has many obvious advantages over traditional sails, it is still less than completely satisfactory in a number of respects. In particular, the trailing edge flap provides a less than optimum degree of control over the positioning of the main wing, which in turn limits the overall efficiency and controllability of the vessel itself. For example, turning the wind to certain angles relative to the wing is difficult to achieve, due in part to characteristics of the flow over the main wing and the flap's location directly in that flow. Response is also affected by sea conditions, and can be weak or sluggish when the wind is light. Furthermore, the relatively weak turning forces that are generated by the trailing edge flap under some conditions means that operation of the system can be compromised if the bearings supporting the pivoting mast develop resistance, due to wear, lack of maintenance or other factors.

These various drawbacks can impair the operation and efficiency of many forms of vessels using wing-type sails, but can be particularly acute in the case of an autonomous unmanned surface vessel (AUSV). AUSV's may be used for many military and civilian purposes, such as surveillance and mapping, for example, and do not carry a human crew that can address or compensate for deficiencies caused by the trailing flap steering system. The nature of the electronic sensors and guidance systems carried on such vessels also means that relatively precise positioning and course holding is frequently important. Moreover, the very nature AUSV's means that they may remain on station or travelling for long periods, often under adverse weather conditions, without a human crew to repair or adjust a mast bearing that may have become resistant to turning.

A motor-assist mechanism might help overcome some of these deficiencies, but would introduce significant complications and costs of its own. Moreover, power to operate a motor is a scarce and valuable commodity on many vessels, especially AUSV's that are intended for long-duration independent operation.

Accordingly, there exists a need for an apparatus for controlling the direction of a wing-type sail of a vessel, that permits precise control over the position of the wing. Furthermore, there exists a need for such an apparatus that is able to positively and rapidly pivot the main wing in any desired direction. Still further, there exists a need for such an apparatus that is effective under wide range wind and sea conditions. Still further, there exists a need for such an apparatus that generates a sufficient turning force to be able to pivot the main wing even if the bearings or other pivotable supports are in less than optimal condition. Still further, there exists a need for such an apparatus if not excessively complicated, and that does not require significant expenditure of onboard power for its operation.

SUMMARY OF THE INVENTION

The present invention has solved the problems cited above, and provides a wing-type sail system comprising: (a) a substantially rigid main wing for extending generally in a vertical plane; (b) means for supporting the main wing for pivoting movement about a substantially vertical axis; (c) first and second secondary airfoils mounted to the main wing so that the secondary airfoils are spaced outwardly from a plane of the main wing on opposite sides thereof; and (d) means for selectively pivoting the secondary airfoils in first and second directions relative to the plane of the main wing, so that the secondary airfoils react with wind passing thereover to exert a force tending to pivoting the main wing in first and second directions about the vertical axis.

The first and second secondary airfoils may be located in positions spaced outwardly from sides of the main wing and rearwardly of the trailing edge thereof. The system may further comprise first and second support booms having the secondary airfoils mounted on distal ends thereof. The base ends of the support booms may be mounted to the main wing proximate the vertical pivot axis.

The means for selectively pivoting the first and secondary airfoils may comprise means for pivoting the secondary airfoils on the distal ends of the support booms, about pivot axes that extend substantially parallel to the vertical pivot axis of the main wing.

The system may further comprise at least one flap member that is mounted at the trailing edge of the main wing, and means for selectively pivoting the at least one flap member about an axis generally parallel to the pivot axis of the main wing. The means for selectively pivoting the flap at the trailing edge of the main wing may comprise means for pivoting the flap in conjunction with the first and second secondary airfoils, so that the flap and secondary airfoils pivot in the same direction simultaneously.

The first and second support booms may be mounted substantially perpendicular to the vertical pivot axis of the main wing, so that the support booms extend from the base ends to the distal ends thereof in a substantially horizontal plane. The horizontal plane of the support booms may be spaced from a lower end of the main wing, so that when installed on a hull assembly of a vessel the support booms will be spaced vertically therefrom so as to permit one or more vertically extending antennae to be mounted on the hull assembly without obstruction. The first and second secondary airfoils may comprise symmetrical airfoils that are substantially mirror-image identical above and below the horizontal plane of the support booms, so as to prevent torsional loading of the booms.

The first and second support booms may extend outwardly and rearwardly from the main wing in a substantially V-shaped configuration lying within the horizontal plane. The system may further comprise means for tensioning the first and second support booms towards one another so as to brace the booms against flexing during operation of the system. The means for tensioning the first and second support booms towards one another may comprise at least one cable interconnecting the support booms that is tensioned so as to deflect the booms resiliently towards one another.

The means for selectively pivoting the first and second secondary airfoils may comprise first and second control cables mounted to each of the secondary airfoils and extending therefrom along the support booms, and means for paying out and retracting the control cables in so as to selectively pivot the secondary airfoils in first and second directions. The means for selectively pivoting the first and second secondary airfoils may comprise means for pivoting the secondary airfoils in response to inputs received from wind direction and speed sensors.

The invention also provides a wind powered vessel, comprising (a) a hull assembly, (b) a wing-type sail system mounted to the hull assembly, the wing-type sail system comprising: (i) a substantially rigid main wing for extending generally in a vertical plane, (ii) means for supporting the main wing for pivoting movement about a substantially vertical axis, (iii) first and second secondary airfoils mounted to the main wing so that the secondary airfoils are spaced outwardly from the plane of the main wing on opposite sides thereof, and (iv) means for selectively pivoting the secondary airfoils in first and second directions relative to the plane of the main wing, so that the secondary airfoils react with wind passing thereover to exert a force tending to pivot the wing in first and second directions about the vertical axis.

The hull assembly of the wind powered vessel may comprise a multi-hull assembly, such as a catamaran.

These and other features and advantages of the present invention will be more fully appreciated from a reading of the following detailed description with reference to the accompanying drawings.

DETAILED DESCRIPTION

Figure 1:
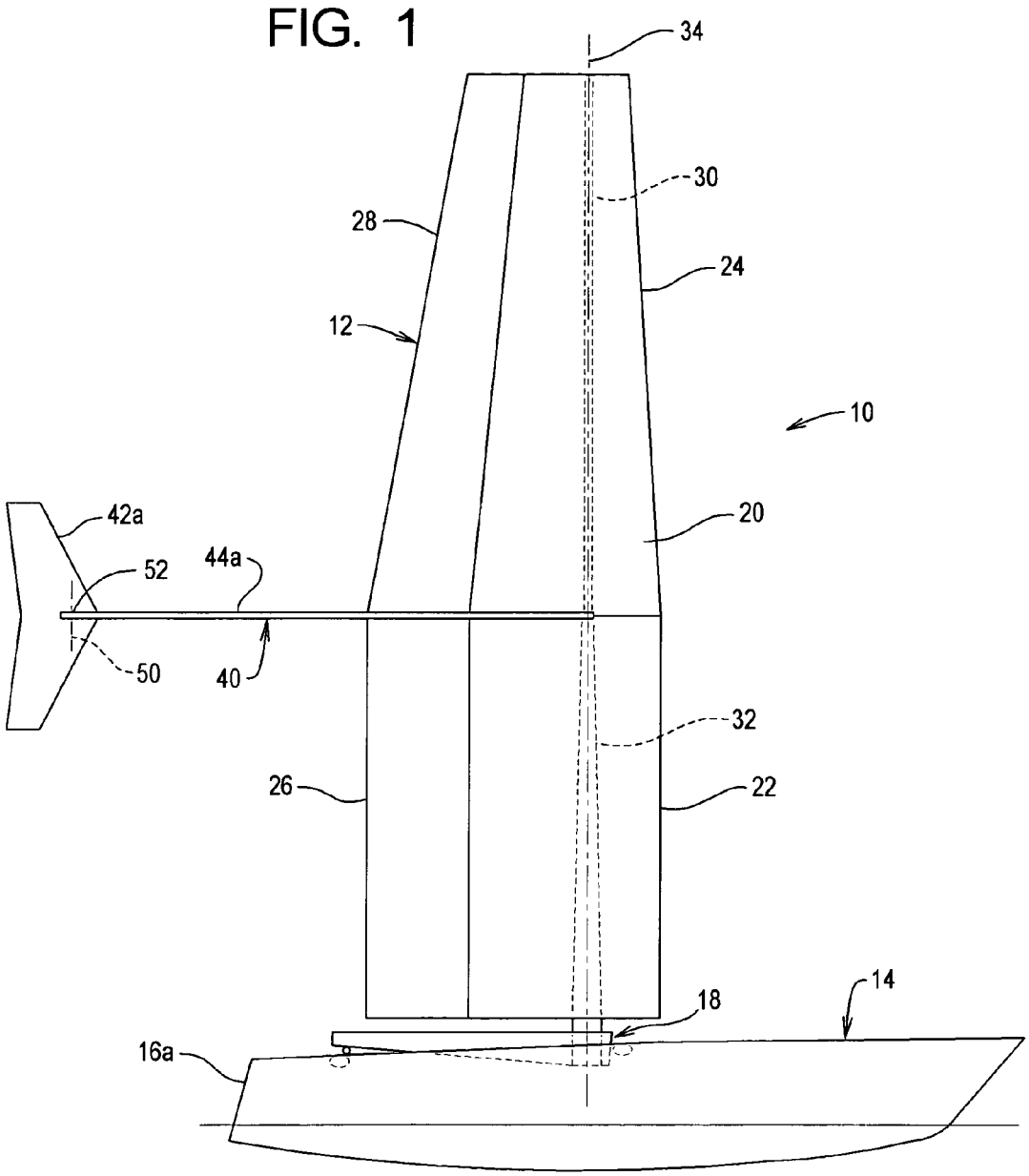
FIG. 1 is a side, elevational view of a vessel having a steerable wing-type sail system in accordance with the present invention installed thereon.
Figure 2:
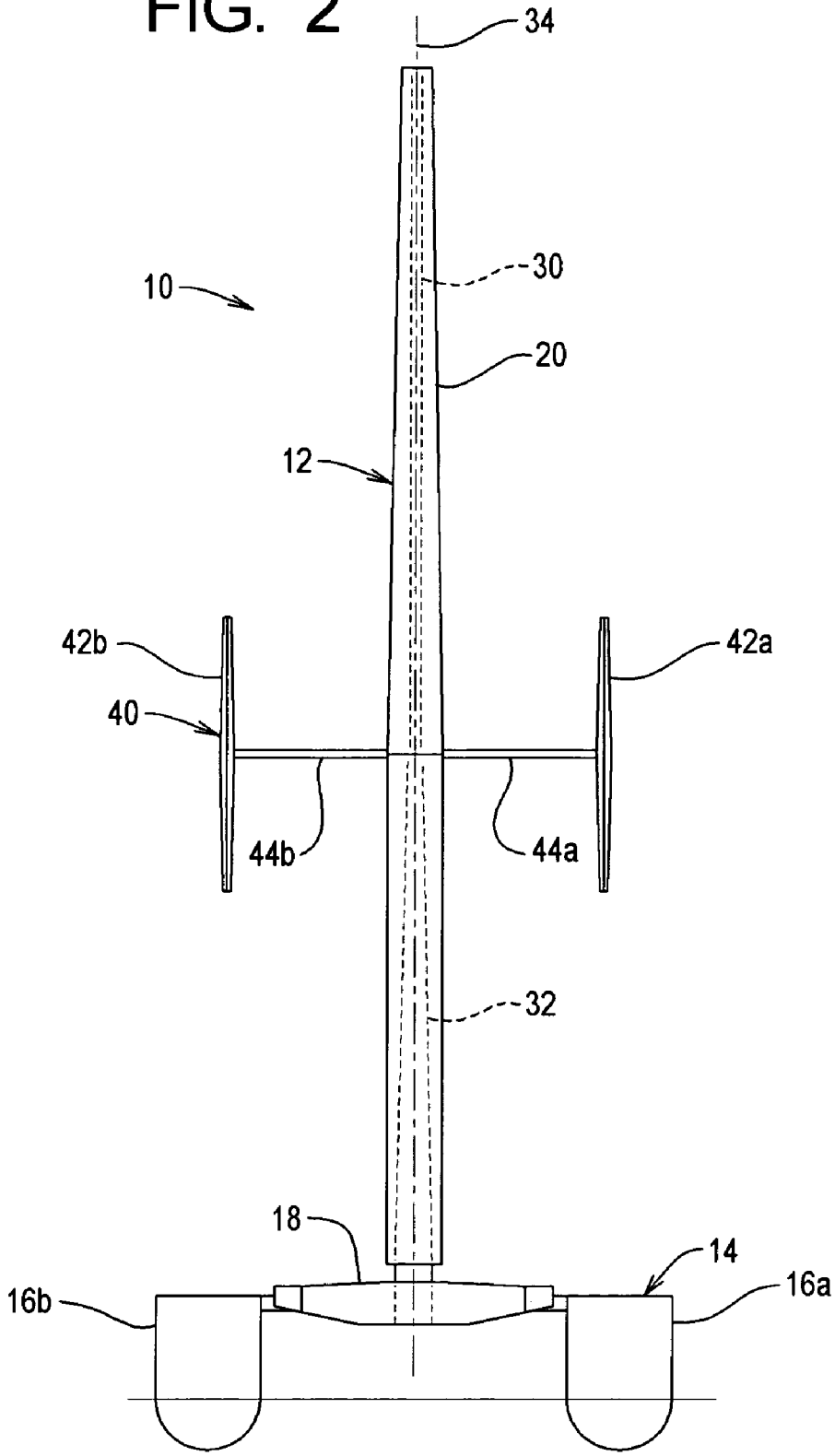
FIG. 2 is an end, elevational view of the vessel and steerable wing-type sail system of FIG. 1, showing in greater detail the relationship of the secondary airfoils to the main wing of the system.

FIG. 1 shows a vessel 10 having a steerable wing-type sail assembly 12 in accordance with the present invention mounted on a hull assembly 14. As can be seen in FIG. 2, the hull assembly in the illustrated embodiment is a catamaran having first and second hull members 16*a*, 16*b* spanned by a bridge or deck structure 18; a catamaran (or trimaran) type hull assembly is an efficient and stable structure that is well suited to use with a wing-type sail, however, it will be understood that other multiple or mono-hull vessels may be used with the steerable wind assembly, as well as other types of craft or even wind powered vehicles.

As can be seen with further reference to FIGS. 1-2, the main wing 20 of the steerable assembly 12 is itself of generally conventional form, with lower and upper spans 22, 24 having a planform shape, the latter tapering upwardly to approximately half the maximum cord length. Pivotable flaps 26, 28 are in turn mounted at the trailing edges of the lower and upper spans. The flaps are joined together vertically and extend the full height of the wing; in the illustrated embodiment, the flaps preferably comprise about 20% of the total area of the planform, and are capable of being deflected in both directions by about 30 degrees. It will be understood that other shapes and forms of wing-type sails may also be used.

A vertical mast 30 within the upper span of the wing is pivotably supported on a post 32 that is enclosed within the lower span. The main wing 20 is therefore free to pivot 360° about axis 34 relative to the hull assembly 14. The axis 34 defined by the post and mast is preferably located at a point which is close to the center of balance of the wing when producing lift, which in the illustrated embodiment is about 25% of the cord length from the wing's leading edge. The support post 32 extends upwardly inside the wing 20 to a level close the vertical center of effort. The top of the post is fitted with a bearing (not shown) that matches a socket inside the main wing spar. The bearing is designed to support the dead weight load of the wing, plus the horizontal aerodynamic loads; due to the proximity of the bearing to the center of effort, it absorbs approximately 110% of the load. A bearing (not shown) is also provided at the bottom of the wing 20, which experiences about 10% of the horizontal load in the opposite direction.

As noted above, in prior wing-type sails the force to pivot the wing-type sail is generated by one or more flaps that lie within the plane of the main wing itself. The present invention, however, provides a steering assembly 40 having at least one pair of secondary airfoils 42*a*, 42*b* that extend generally parallel, to but that are offset laterally from, the plane of the main wing. As will be described in later detail below, the secondary foils 42*a*, 42*b* are pivotably supported on the distal ends of booms 44*a*, 44*b*, the base ends of the booms being mounted to the main wing assembly proximate its base pivot axis 34. As can be seen in FIG. 1 and also FIG. 3, the length of the booms also serves to position the secondary airfoils 42*a*, 42*b* well behind the trailing edge of the main wing 20. As will be described in greater detail below, the secondary airfoils are rigged to pivot the same direction simultaneously, preferably in conjunction with pivoting of the trailing edge flap 26; as this is done, the rotational force generated by the wind reacting against the angled secondary airfoils 42*a*, 42*b* is transmitted into the main wing through the elongate booms 44*a*, 44*b*. Although only a single pair of secondary airfoils is shown in the illustrated embodiment, it will be understood that multiple pairs may be used in some instances, and also that the secondary airfoils in each set may be doubled up or otherwise increased in number from the two airfoils that are shown.

The steering assembly of the present invention, having the secondary airfoils as described, provides several important advantages. Firstly, the secondary airfoils (also referred to from time-to-time herein as "secondary wings" or "tails") are at an elevation close to the vertical center of effort of the main wing, and thus experience the same wind velocities and wind directions as the wing itself. In this respect, it should be noted that, due to friction and viscosity, the true wind velocity varies with its height above the water or ground, typically being significantly slower at lower levels. This, in turn, creates a difference in the apparent angle of the wind to the direction of the vessel's movement at different heights above the water. By way of background, some designers have attempted to compensate for this phenomenon by incorporating twists or curves in the shapes of sails.

An additional advantage is that the lateral displacement of the secondary airfoils removes them from the disturbed downwash air that results from the main wing producing lift. The secondary airfoils are therefore able to produce lift much more efficiently, thus permitting smaller and lighter airfoils to be used, and they are also able to produce a smoother, more consistent pivoting action.

The location of the booms near of the mid-span height of the wing also provides vertical clearance above the hull assembly that allows communication antennae and the like to be mounted near the transom area without obstructing the booms; this is an advantage over using a single secondary air foil mounted behind the wing on two vertically separated booms, where the lower of the two booms would sweep over the after portion of the vessel so that only small objects could be mounted in this area. Moreover, the length of the booms also provides leverage that aid in turning the wing assembly.

The two horizontal booms 44*a*, 44*b* are preferably mirror-image identical, and diverge rearwardly in a V-shaped configuration. The base ends of the booms are mounted in sockets (not shown) formed in rear face of the main wing spar. First and second struts or arms 46*a*, 46*b* extend laterally from the rearward part of the wing to support the booms in the horizontal plane.

Figure 4:
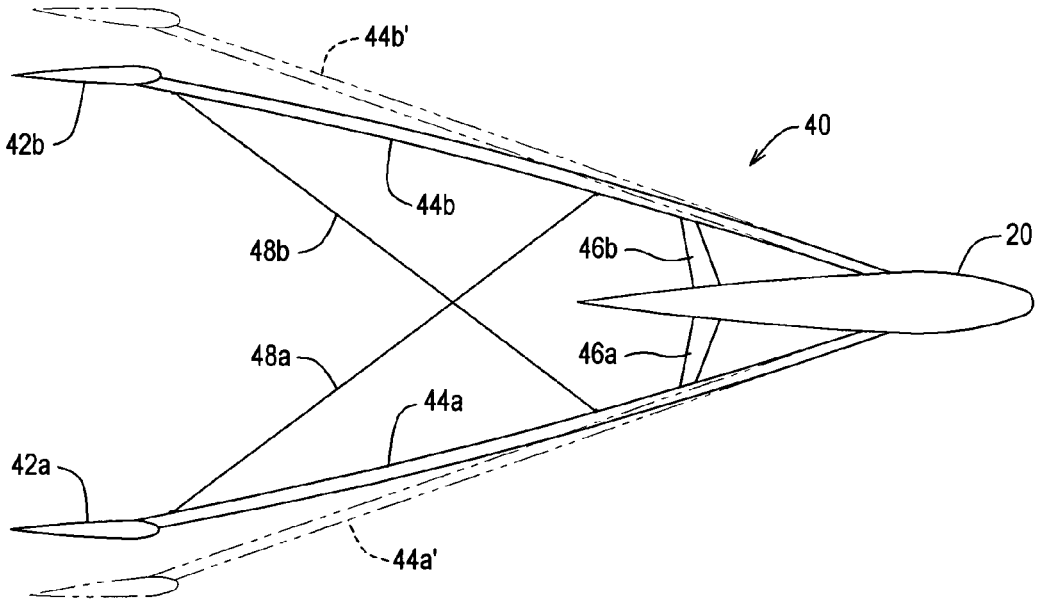
FIG. 4 is a simplified, plan view of the main wing and secondary air foil assembly of the system of FIGS. 1-3, showing the manner in which the booms that support the secondary airfoils are tensioned inwardly towards one another to brace the booms against flexing during use.

As can be seen FIG. 4, the booms 44*a*, 44*b* are drawn together behind the main wing by diagonal cables 48*a*, 48*b*, so that the booms are deflected resiliently from the unloaded positions indicated at 44*a*' and 44*b*'. The forces of drawing the ends of the booms together are selected to be greater the anticipated wind loads, so that the cables will never develop slack during operation. The preloading provides a bracing that eliminates the flexing that might otherwise occur in a cantilever situation; any flexing of the booms would tend to change the angle of attack of the secondary airfoils, resulting in serious control problems.

The tensioned boom arrangement that has been described has the advantages of providing a lightweight and inexpensive have, however it will be understood that in some embodiments booms may be used that have sufficient rigidity to avoid flexing without requiring pretensioning.

Referring again to FIG. 1, the secondary airfoils 42*a*, 42*b* are mounted to pivot about vertical axes 50 that extend parallel to the vertical pivot axis 34 of the main wing 20. The secondary airfoils are preferably symmetrical, with mirror-image identical upper and lower halves above and below the booms 44*a*, 44*b*, to avoid transmitting torsional loads to the booms. In the illustrated embodiment the secondary airfoils have a swept "V" shape, however, it will be understood that other symmetrical shapes (e.g., rectangular, diamond-shaped or oval) may be used.

Figure 5:
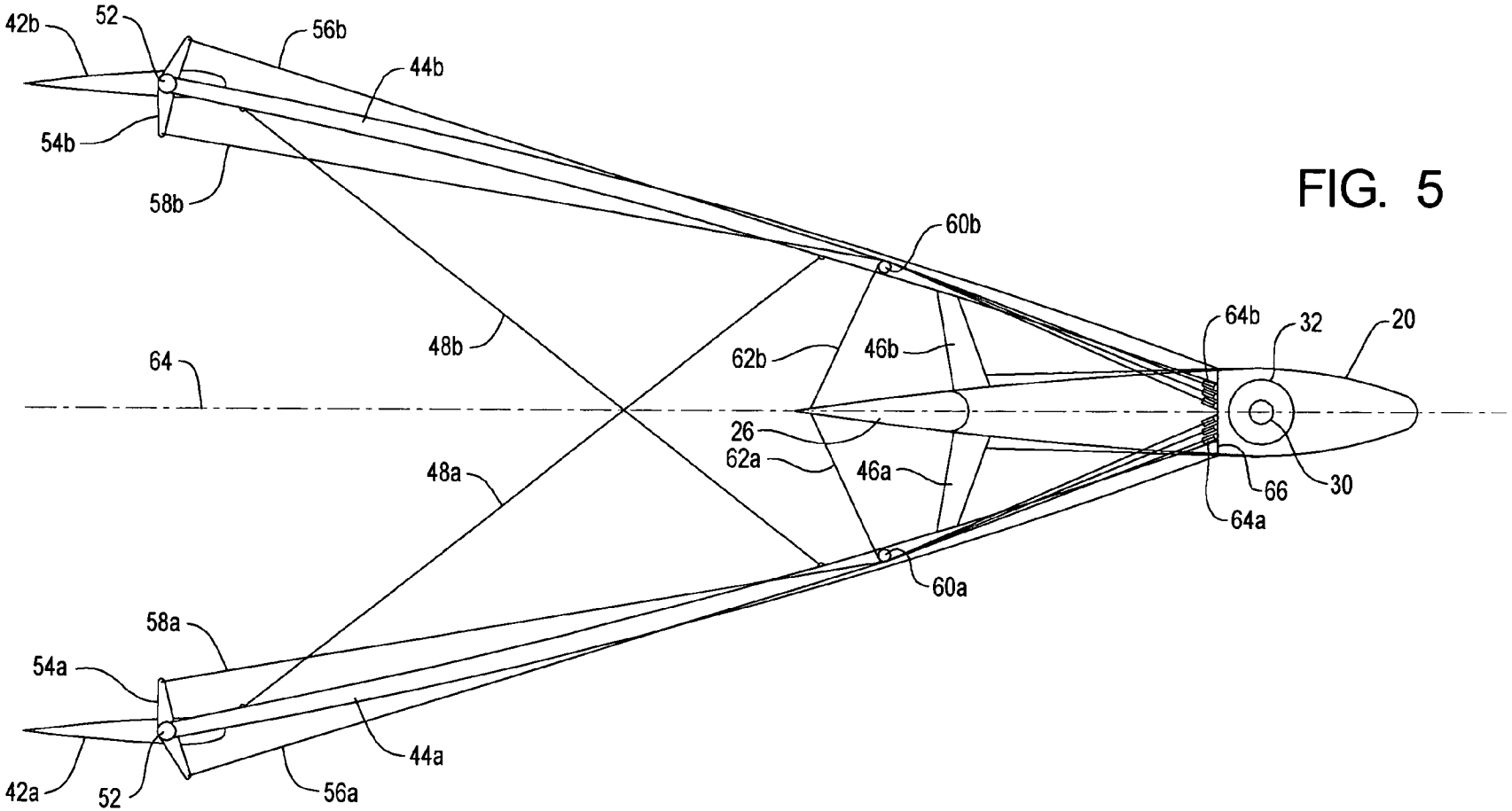
FIG. 5 is an enlarged, plan view of the wing and secondary air foil assembly of FIGS. 1-3, showing the control lines by which the secondary airfoils and also the trailing edge flap of the main wing are actuated.

The vertical shafts 52 (see also FIG. 5) that support the secondary airfoils 42*a*, 42*b* are located as near as possible to the aerodynamic centers of the airfoils, thus reducing steering cable tensions and motor control requirements. The pivot shafts are mounted to crossbars 54*a*, 54*b*, which have ends that extend generally laterally on either side of the airfoils 42*a*, 42*b*; as can be seen in FIG. 5, the crossbars preferably extend perpendicular to the support booms 44*a*, 44*b* rather than to the secondary airfoils themselves, to simplify the arrangement of the cables and controls.

Pairs of outboard and inboard cables 56*a*, 58*a* and 56*b*, 58*b* are mounted to the projecting ends of the crossbars 54*a*, 54*b*, and are led forward over vertical-axis tensioner pulleys 60*a*, 60*b* that are mounted on the booms to the sides of the flap 26. Additional cables 62*a*, 62*b* are attached on opposite sides to the rearward edge of the flap, and are similarly routed over the vertical axis pulleys 60*a*, 60*b*. As can be seen in FIG. 5, the cables 62*a*, 62*b* are therefore aligned at a relatively steep, obtuse angle relative to the main plane 64 of the wing, tending slightly forward so that they will be generally perpendicular to the flap when it is the maximum angle of deflection; similarly, the paired cables 56*a*, 58*a* and 56*b*, 58*b* are arranged more or less perpendicular to the transverse crossbars 54*a*, 54*b* when the secondary airfoils are in their neutral positions.

All six of the control cables (54*a*, 58*a*, 56*a*, 58*b*, 62*a* and 62*b*) are routed forwardly from the vertical axis pulleys over two sets of horizontal axis pulleys 64*a*, 64*b*, that are mounted to a boxed in wall 66 or other support constructed within the wing just behind the area of the post and mast 32, 30. The horizontal axis pulley sets 64*a*, 64*b* redirect the control cables vertically through the wing to linear actuators (not shown) or similar mechanisms mounted to the deck structure 18, or within the hull assembly itself. By shortening/lengthening the control cables, the assembly therefore pivots both the trailing edge flap and secondary airfoils in one direction or the other simultaneously.

Figure 6:
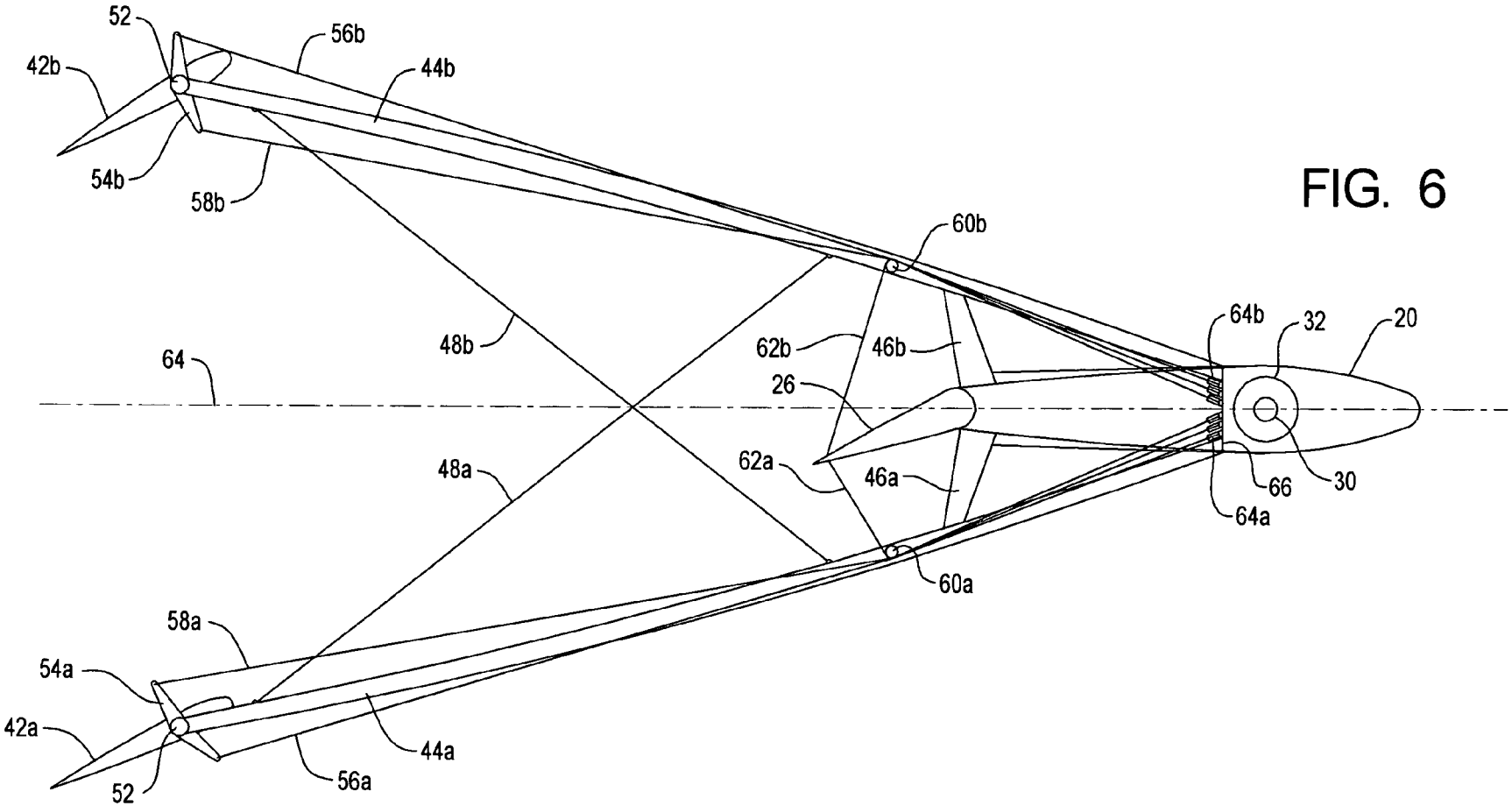
FIG. 6 is a top, plan view of the wing and secondary air foil assembly of FIG. 5, showing the manner in which the secondary airfoils and trailing edge flap are pivoted simultaneously in order to turn the main wing towards a desired direction.

For example, FIG. 6 shows a configuration in which the right-side set of cables 56*a*, 58*b* and 62*a* have been retracted, using the linear actuators or other mechanism, while the left-side cables 58*a*, 56*b* and 62*b* have been paid out, thus pivoting the flap 26 and secondary airfoils 42*a*, 42*b* so that they are all inclined towards the left of the plane 64 of the main wing. As a result, the inclined members react with the wind (assuming that the latter is generally from ahead of the main wing 20) to produce a force tending to pivot the wing in the opposite direction, i.e., to the right (clockwise direction) in the view shown in FIG. 6. Retracting and paying out the opposite sets of cables likewise pivots the flap and secondary airfoils in the opposite direction.

In some embodiments the secondary airfoils may be pivoted by other mechanism, such as motors or hydraulic or pneumatic mechanisms operating directly or through linkages, rather than or in addition to the cables that are shown.

The amount of the turning force exerted on the main wing can be adjusted by increasing or decreasing the angle of the secondary airfoils as desired, e.g., a greater degree of inclination may be used to turn the wind rapidly to make major changes in alignment, or to overcome resistance due to environmental or mechanical conditions, while a lesser degree of inclination may be used for fine adjustments or minor corrections in alignment. The members can be constructed to provide any desired range of pivoting motion, however, a maximum inclination in a range from about 30-45 degrees will be satisfactory for a majority of applications.

Accordingly, by operatively linking the linear actuators, or other cable adjustment mechanism or mechanisms, to suitable controls on the vessel, the steering assembly of the present invention enables the direction and lift of the wing to be controlled with a high degree of efficiency and precision. The on board controls may include wind speed and direction sensors, as well as GPS, gyrocompass, speed log and/or other mechanisms for determining vessel course, speed and position. The inputs from the sensors may be supplied to an on board computer or other processor, that provides commands to the linear actuators or other cable control mechanisms as appropriate, and possibly to the rudders or other steering mechanism of the hull assembly as well. Moreover, the guidance system may include provisions for receiving commands from a remote location, such as a land station or mother vessel.

Figure 7:
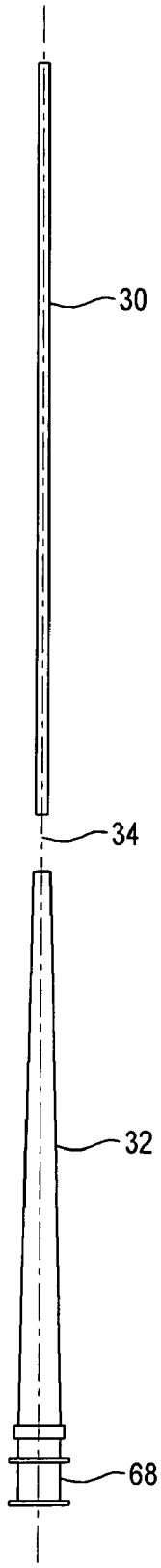
FIG. 7 is an elevational view the pivoting mast assembly of the system of FIGS. 1-3.

FIG. 7 shows the relationship of the mast 30 to the post 32 in greater detail. As can be seen, the post is preferably a vertically tapered member, to provide adequately strength without excessively elevating the center of gravity. The base portion 68 of the post is suitably formed as a plug or similar member that is received in a cooperating socket (not shown) or other receiver in the deck assembly 18.

Figure 3:
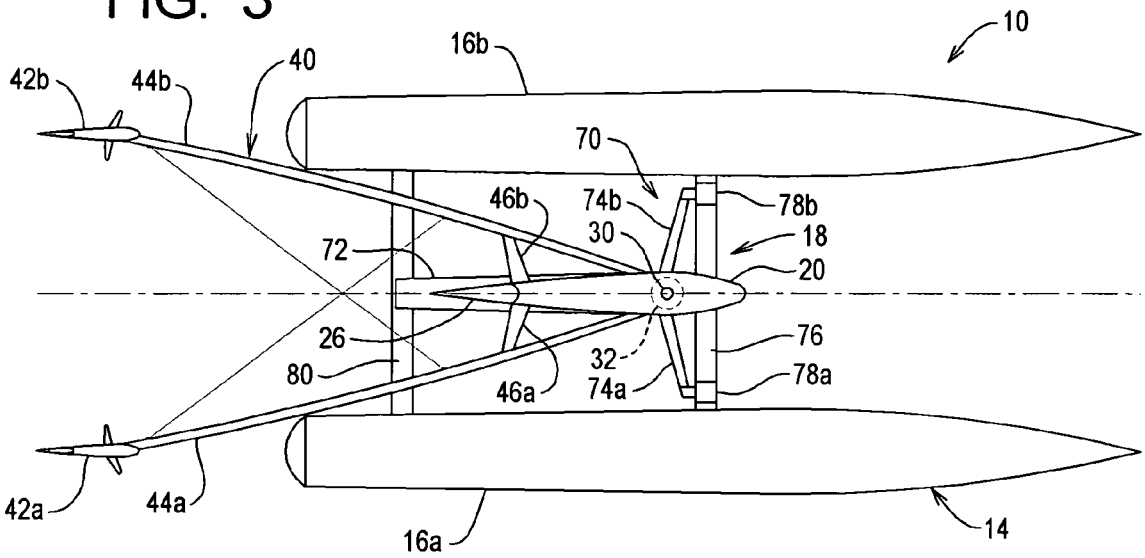
FIG. 3 is a top, plan view of the vessel and steerable wing-type sail system of FIGS. 1-2, showing in greater detail the booms by which the secondary airfoils are supported from the main wing of the system.

As can be seen in FIG. 3 and also FIG. 7, the socket or other receptacle for the post 32 may be formed in or mounted to a frame 70 of the deck assembly that is pivotable about a horizontal axis, in order to allow the main wing to be lowered to a horizontal orientation when desired. In the illustrated embodiment, the frame is T-shaped, having a longitudinally extending centerline platform member 72 and first and second laterally and forwardly extending leg members 74*a*, 74*b*. The outboard ends of the two leg members are mounted to a forward bridge piece 76 of the deck assembly by pivot connections 78*a*, 78*b*; in the illustrated embodiment, the pivot connections are formed by tubular sleeves that fit over and engage cooperating portions of the bridge piece 76.

Figure 8:
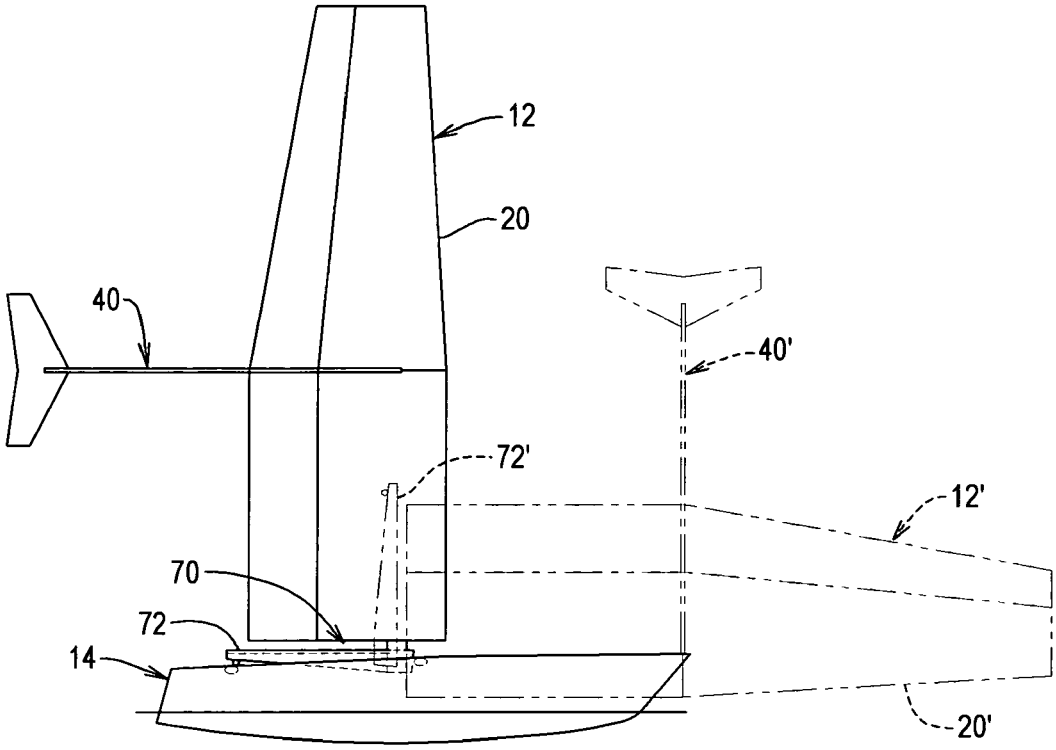
FIG. 8 is a side, elevational view of the vessel and steerable wing-type sail system of FIG. 1, with a dotted line image showing the manner in which the wing assembly pivots to a horizontal orientation for service and/or storage or transport of the vessel.

When the wing assembly is deployed to its vertical position (e.g., for normal operation of the vessel), the rearward end of the longitudinal platform member 72 is supported on an aft bridge member 80 of the deck assembly, as is shown in FIG. 3 and also FIG. 1. Then it is desired to lower the wing assembly, the platform member is detached from the aft bridge member and the wing assembly is pivoted forwardly until the wing reaches the horizontal orientation, as indicated by dotted line images 12', 20' and 40' in FIG. 8. In this position, antennae and/or sensors (e.g., radar) mounted atop the wing assembly can be accessed for maintenance/repair, or the wing and steering assembly can be broken down for storage or transportation.

It is to be recognized that various alterations, modifications, and/or additions may be introduced into the constructions and arrangements of parts described above without departing from the spirit or ambit of the present invention as defined by the appended claims.

What is claimed is:

1. A wing-type sail system, comprising:

a substantially rigid main wing-type sail for extending generally in a vertical plane;

means for supporting said main wing-type sail for pivoting movement about a substantially vertical axis;

first and second secondary airfoils mounted to said main wing-type sail so that said secondary airfoils are spaced outwardly from said plane of said main wing-type sail on opposite sides thereof, said first and second secondary airfoils being located in positions spaced outwardly from sides of said main wing-type sail and rearwardly of a trailing edge thereof; and means for selectively pivoting said secondary airfoils in first and second directions relative to said plane of said main wing-type sail, so that said secondary airfoils react with wind passing thereover to exert a force tending to pivot said wing-type sail in first and second directions about said vertical axis.

2. The wing-type sail system of claim 1, further comprising:

first and second support booms having said secondary airfoils mounted on distal ends thereof at said positions spaced outwardly from sides of said main wing-type sail and rearwardly of said trailing edge thereof.

3. The wing-type sail system of claim 2, wherein base ends of said support booms are mounted to said main wing-type sail proximate said vertical pivot axis.

4. The wing-type sail system of claim 3, wherein said means for selectively pivoting said first and second secondary airfoils comprises:

means for pivoting said secondary airfoils on said distal ends of said support booms about pivot axes that extend generally parallel to said pivot axis of said main wing-type sail.

5. The wing-type sail system of claim 4, further comprising:

at least one flap that is mounted at said trailing edge of said main wing-type sail; and means for selectively pivoting said at least one flap about an axis generally parallel to said pivot axis of said main wing-type sail.

6. The wing-type sail system of claim 5, wherein said means for selectively pivoting said flap mounted at said trailing edge of said main wing-type sail comprises:

means for pivoting said flap in conjunction with said first and second secondary airfoils so that said flap and secondary airfoils pivot in the same direction simultaneously.

7. The wing-type sail system of claim 6, wherein said first and second support booms are mounted substantially perpendicular to said vertical pivot axis of said main wing-type sail so as to extend from said base ends to said distal ends thereof in a substantially horizontal plane.

8. The wing-type sail system of claim 7, wherein said horizontal plane of said support booms is spaced from a lower end of said main wing-type sail, so that when installed on a hull assembly of a vessel said support booms will be spaced vertically therefrom so as to permit one or more vertically extending antennae to be mounted on said hull assembly without obstructing said booms.

9. The wing-type sail system of claim 8, wherein said first and second secondary airfoils comprise:

symmetrical airfoils that are substantially mirror-image identical above and below said horizontal plane said support booms, so as to prevent torsional loading of said booms.

10. The wing-type sail system of claim 9, wherein said first and second support booms extend outwardly and rearwardly from said main wing-type sail in a substantially V-shaped configuration lying in said horizontal plane.

11. The wing-type sail system of claim 10, further comprising:

means for tensioning said first and second support booms towards one another so as to brace said booms against flexing during operation of said system.

12. The wing-type sail system of claim 11, wherein said means for tensioning said first and second support booms towards one another comprises:

at least one cable interconnecting said support booms that is tensioned so as to deflect said booms resiliently towards one another.

13. The wing-type sail system of claim 4, wherein said means for selectively pivoting said first and second secondary airfoils comprises:

first and second control cables mounted to each of said secondary airfoils and extending along said support booms; and means for selectively paying out and retracting said control cables so as to selectively pivot said secondary airfoils in first and second directions.

14. The wing-type sail system of claim 4, wherein said means for selectively pivoting said first and second airfoils comprises:

means for pivoting said secondary airfoils in response to signals received from wind speed and direction sensors.

15. A wind powered vessel comprising:

a hull assembly;

a wing-type sail mounted to said hull assembly, said wing-type sail system comprising:

a substantially rigid main wing-type sail for extending generally in a vertical plane;

means for supporting said main wing-type sail for pivoting movement about a substantially vertical axis;

first and second secondary airfoils mounted to said main wing-type sail so that said secondary airfoils are spaced outwardly from said plane of said main wing-type sail on opposite sides thereof, said first and second secondary airfoils being located in positions spaced outwardly from sides of said main wing-type sail and rearwardly of a trailing edge thereof; and means for selectively pivoting said secondary airfoils in first and second directions relative to said main plane of said wing-type sail, so that said secondary airfoils react with wind passing thereover to exert a force tending to pivot said main wing-type sail in first and second directions about said vertical axis.

16. The wind powered vessel of claim 15, wherein said hull assembly comprises:

a multi-hull assembly.

17. The wind powered vessel of claim 15, further comprising:

first and second support booms having said secondary airfoils mounted on distal ends thereof at said positions spaced outwardly from sides of said main wing-type sail and rearwardly of said trailing edge thereof.

18. The wind powered vessel of claim 17, wherein base ends of said support booms are mounted to said main wing-type sail proximate said vertical pivot axis.

19. The wind powered vessel of claim 18, wherein said means for selectively pivoting said first and second secondary airfoils comprises:

means for pivoting said secondary airfoils on said distal ends of said support booms about pivot axes that extend generally parallel to said pivot axis of said main wing-type sail.

20. The wind powered vessel of claim 19, wherein said first and second support booms are mounted substantially perpendicular to said vertical pivot axis of said main wing-type sail so as to extend from said base ends to said distal ends in a substantially horizontal plane.

21. The wind powered vessel of claim 19, wherein said horizontal plane of said support booms is spaced from a lower end of said main wing-type sail, so that said support booms are spaced vertically from said hull assembly of said vessel so as to permit one or more vertically extending antennae to be mounted on said hull assembly without obstructing said booms.

22. The wind powered vessel of claim 17, further comprising:

at least one flap that is mounted at said trailing edge of said main wing-type sail; and means for selectively pivoting said at least one flap about an axis generally parallel to said pivot axis of said main wing-type sail.

23. The wind powered vessel of claim 22, wherein said means for selectively pivoting said flap mounted at said trailing edge of said main wing-type sail comprises:

means for pivoting said flap in conjunction with said first and second secondary airfoils so that said flap and secondary airfoils pivot in the same direction simultaneously.

* * * * *

UNITED STATES PATENT AND TRADEMARK OFFICE

CERTIFICATE OF CORRECTION

PATENT NO. : 7,461,609 B1
APPLICATION NO. : 11/706796
DATED : December 9, 2008
INVENTOR(S) : Mark T. Ott and David W. Hubbard It is certified that error appears in the above-identified patent and that said Letters Patent is hereby corrected as shown below:

In the specification, following the title and before the subheading "BACKGROUND", please add the following:

STATEMENT REGARDING FEDERALLY SPONSORED RESEARCH OR DEVELOPMENT

The U.S. Government has a paid-up license in this invention and the right in limited circumstances to require the patent owner to license others on reasonable terms as provided for by the terms of Subcontract 04-4148-012 under TSM Corporation Prime Contract N00178-04-D-4148 awarded by Naval Sea Systems Command.

Signed and Sealed this

Seventh Day of September, 2010

David J. Kappos

David J. Kappos
*Director of the United States Patent and Trademark Office*